United States Patent [19]

Milles

[11] Patent Number: 4,817,064

[45] Date of Patent: Mar. 28, 1989

[54] STRUCTURE FOR FABRICATING JEWELRY PARTS OR WRIST WATCHES

[76] Inventor: Victor A. Milles, St. Gallerstr. 55, Wil, Switzerland

[21] Appl. No.: 921,052

[22] PCT Filed: Jan. 27, 1986

[86] PCT No.: PCT/CH86/00011

§ 371 Date: Oct. 2, 1986

§ 102(e) Date: Oct. 2, 1986

[87] PCT Pub. No.: WO86/04696

PCT Pub. Date: Aug. 14, 1986

[30] Foreign Application Priority Data

Feb. 5, 1985 [CH] Switzerland ..... 519/85

[51] Int. Cl.[4] ..... G04B 37/00; A44C 25/00

[52] U.S. Cl. ..... 368/282; 63/21; 63/1.1; 63/29.1; 224/164

[58] Field of Search ..... 368/276, 281–282, 368/294, 299, 300; 63/1 R, 3, 4, 21, 26, DIG. 1; 224/164, 175

[56] References Cited

U.S. PATENT DOCUMENTS

| | | | |
|---|---|---|---|
| 1,544,619 | 7/1925 | Wakefield | 63/28 |
| 1,740,060 | 12/1929 | Baum | 63/3 |
| 2,316,225 | 4/1943 | Hoffman | 63/29 |
| 3,014,298 | 12/1961 | Kirshner | 368/285 |
| 3,077,089 | 2/1963 | Silverman | 63/3 |
| 3,733,851 | 5/1973 | D'Apuzzo | 63/1 R |
| 4,353,124 | 10/1982 | Weinzettel | 368/258 |
| 4,393,667 | 7/1983 | Reinstein et al. | 63/29 R |
| 4,447,162 | 5/1984 | Mitamura et al. | 368/294 |
| 4,545,688 | 10/1985 | Ray et al. | 368/291 |

FOREIGN PATENT DOCUMENTS

| | | | |
|---|---|---|---|
| 0046312 | 2/1982 | European Pat. Off. . | |
| 2613678 | 10/1977 | Fed. Rep. of Germany . | |
| 2921597 | 12/1980 | Fed. Rep. of Germany . | |
| 2433317 | 3/1980 | France . | |
| 2448874 | 9/1980 | France . | |
| 2524778 | 10/1983 | France | 63/1 R |
| 258386 | 5/1949 | Switzerland . | |
| 349223 | 11/1960 | Switzerland . | |
| 377286 | 10/1963 | Switzerland . | |
| 640690 | 1/1984 | Switzerland . | |
| 859188 | 1/1961 | United Kingdom | 63/DIG. 3 |

*Primary Examiner*—Vit W. Miska

*Attorney, Agent, or Firm*—Helfgott & Karas

[57] ABSTRACT

An article of jewelry or wrist watches with at least one gem stone or a watch, the gem stone (3) or parts of the watch are associated with a holding element (2) and are interchangeably joined thereto together with a support (1). Thus, as a function of the individual taste of the wearer, it is possible to fabricate jewelry parts or decorative watches with different shapes and colors.

8 Claims, 7 Drawing Sheets

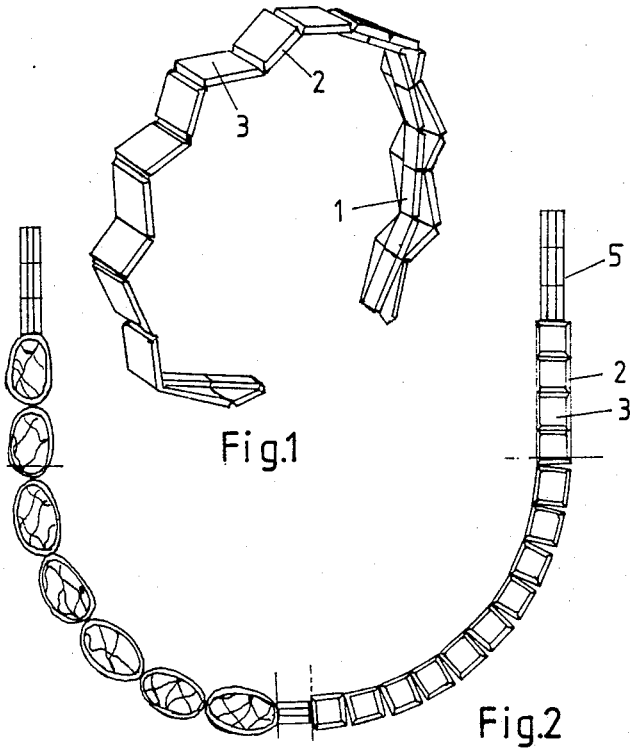
Fig.1
Fig.2
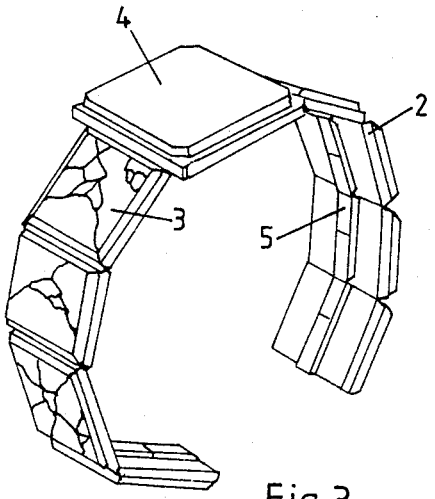
Fig.3
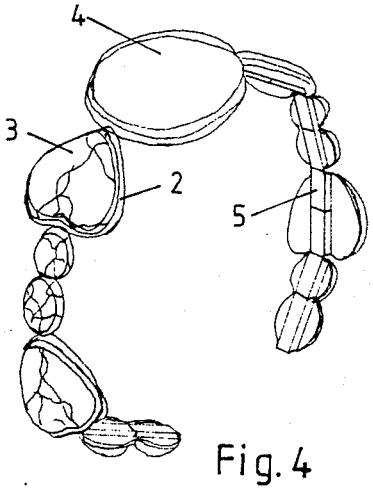
Fig. 4

Fig. 5
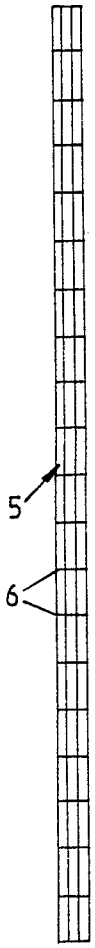
Fig. 6
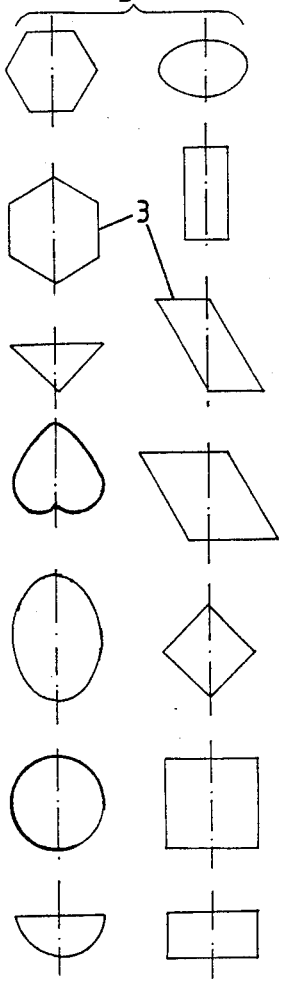
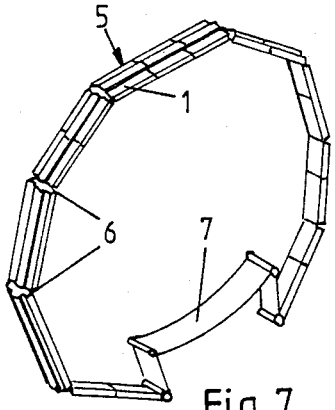
Fig. 7
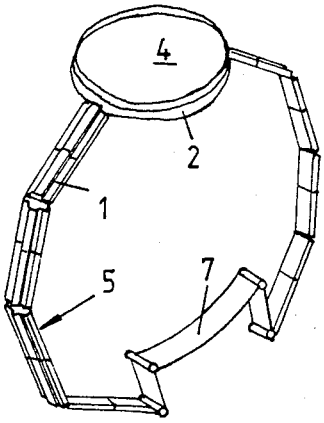
Fig. 8
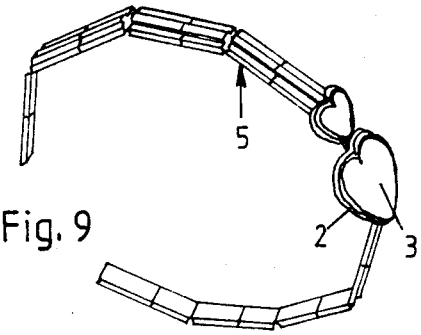
Fig. 9

STRUCTURE FOR FABRICATING JEWELRY PARTS OR WRIST WATCHES

The invention relates to a structure for fabricating jewelry parts or wrist watches with at least one gem stone or a watch, as well as a piece of jewelry with a gem stone and/or a watch.

Conventionally pieces of jewelry are so fabricated from gem stones, that the latter, no matter whether they are precious or semiprecious stones, are directly fixed to a support, such as e.g. a gold ring or hoop, or are arranged between individual chain sections. Thus, the piece of jewelry has its shape and color fixed once and for all.

Modern wrist watches are also generally not interchangeably connected to a watch strap. However, of late, a wrist watch has been developed, in which a watch case can be associated, as desired, with different watch straps and can be given decorative ring elements. However, this merely provides a possibility of using watch straps of different form and color with said fixed associated cases.

The object of the present invention is to structure of the aforementioned type of jewelry parts, which are randomly interchangeable and combinable, whilst using only one fixed basic element. Use is in particular to be made of the possibilities which are described in the method for fabricating semiprecious stone-like gems as a substitute for semiprecious stones according to Swiss patent application No. 6954/83-5.

The above object is achieved by structure of the aforementioned type in which the gem stone or parts of the watch are associated with a holding element and are interchangeably joined thereto together with a support.

The support forms a basic fitting which depends on the intended use and the special requirements of the wearer. Thus, as an individual element, the support can e.g. be inserted in a ring. If the wearer requires for her clothing a particular color or shape combination of the gem stone, then she can place it together with the corresponding holding element on the support. When changing the clothing, it is also possible for her to correspondingly change the gem. The same also applies for ear clips, cufflinks, etc, as well as for bracelets and necklaces, where e.g. several such supports are provided on a band. Thus, the wearer can in a simple manner assemble or make up a piece of jewelry and can modify it as a function of her taste.

The same inventive principle applies when using a watch as a jewelry item. It is then possible to change watch glasses of different shades, as well as the complete upper part of the case, which can once again be in the form of a piece of jewelry. It is also possible to surround a watch with a plurality of gems. There are so many possible variants, that only a few examples can be given here. In addition, this building block system can be extended at random, whilst once again taking account of individual taste.

Further advantages, features and details of the invention can be gathered from the following description of preferred embodiments relative to the drawings, wherein like reference character designate like parts and wherein:

FIG. 1 is a perspective view of a bracelet according to this invention.

FIG. 2 is a plan view of a necklace in two embodiments.

FIGS. 3 and 4 are perspective views of two embodiments of wrist watches.

FIG. 5 is a plan view of an opened out support.

FIG. 6 is a diagrammatic view of various gem forms.

FIG. 7 is a perspective view of a watch strap.

FIG. 8 is a perspective view of the watch strap according to FIG. 7 carrying a watch.

FIG. 9 is a perspective view of a bracelet, partly covered with gems.

Figure 10:
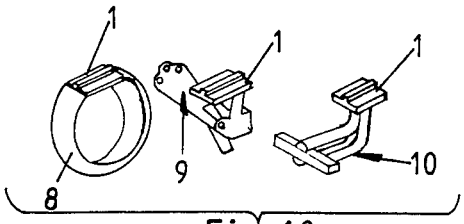
FIG. 10 is a perspective view of three further gem supports.

FIGS. 1 to 4 show as examples of jewelry items produced according to the structure and method of the present invention, respectively, a bracelet, a necklace and wrist watches. Each piece of jewelry essentially comprises supports 1, which in the present case are assembled end-to-end to form a strap or band section 5, a holding element 2, also with different configurations, and the actual gem stone 3 or the watch glass 4 covering a not further shown clockwork.

In FIG. 2 the support 1 constructed as strap portion 5 is for the purposes of illustration only partly covered gems 3. The individual supports 1 of strap part 5 are separated according to FIG. 5 by desired bending points or lines 6, so that the strap part 5 can e.g. be formed into a bracelet or watch strap, as shown in FIGS. 7 to 9. The desired bending lines 6 can be formed in that the individual supports 1 are separately fixed to a flexible band. However, it is also possible to provide separate connecting pieces for the individual supports 1.

Examples of different gem stones 3 are shown in FIG. 6.

According to FIG. 7 a strap part 5 formed from individual supports 1 is made into a watch strap, a clasp 7 interconnecting the two ends of the strap part 5. In FIG. 8 the strap part 5 according to FIG. 7 already has the holding elements 2 and watch glass 4. FIG. 9 shows the start of covering a strap part 5 with gems 3 carried by holding elements 2.

Figure 11:
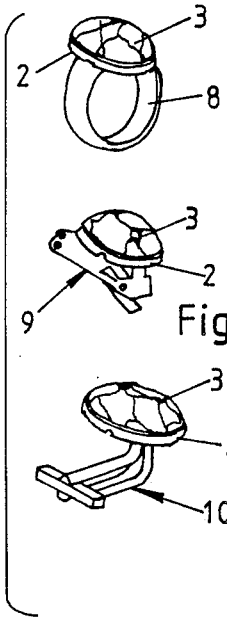
FIGS. 11 and 12 are perspective views of the finished gems according to FIG. 10.
Figure 12:
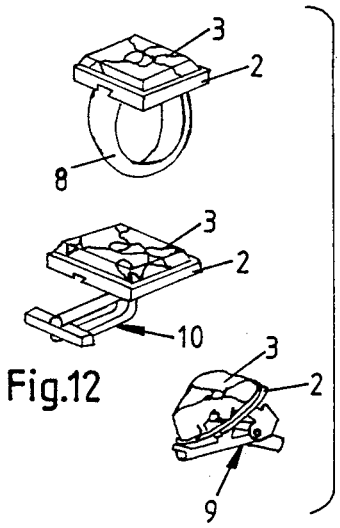

FIG. 10 shows a different arrangement of the supports 1 for rings, ear clips, cufflinks, etc. Only a single support 1 is required and is fixed to jewelry parts 8 or fixing parts 9, 10. According to FIGS. 11 and 12 said supports 1 are provided with differently shaped holding elements 2 adapted to the particular pieces of jewelry 3.

Figure 13:
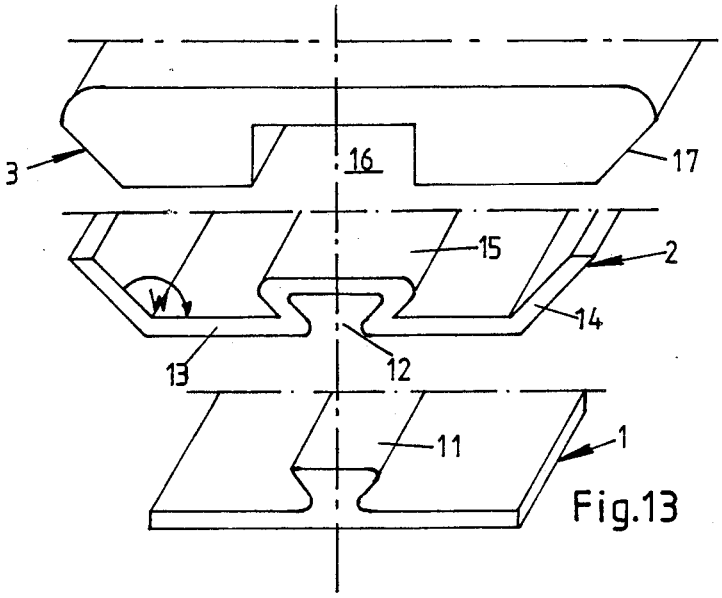
FIG. 13 is a perspective view of a partly shown, inventive jewelry part in exploded form.

FIG. 13 shows those parts which, according to the invention, are assembled to form a piece of jewelry. Support 1 is constructed here as a rail element and has a cross-sectionally dovetailed rail 11, whose shape corresponds to a groove 12 in holding element 2. The latter is also U-shaped with a base part 13, as well as two legs 14 at an angle w to base part 13. From base part 13, groove 12 once again forms a dovetail-like tongue 15, which fits into a channel 16 of gem stone 3. The side walls 17 of gem stone 3 are adapted to the shape of holding element 2. Gem 3 can be fixed, e.g. bonded to holding element 2. Channel 16 can also have a shape adapted to tongue 15 with undercuts, so that gem 3 is positively secured.

Figure 14:
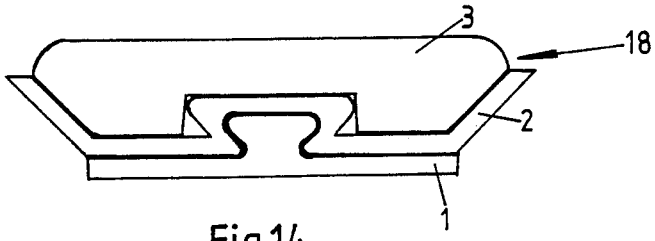
FIG. 14 is a front view of the assembled jewelry part according to FIG. 13.
Figure 15:
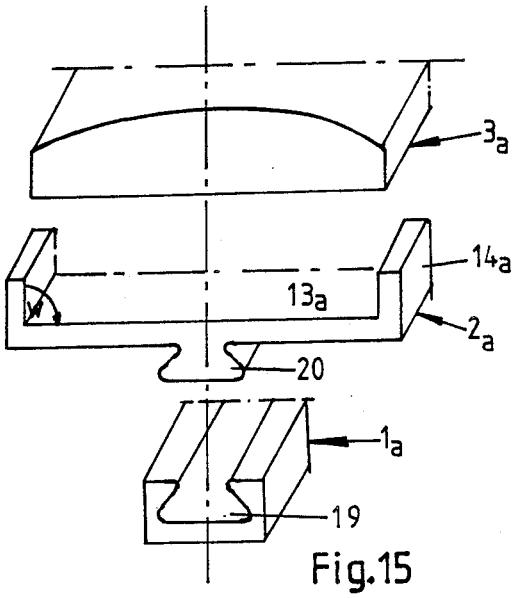
FIG. 15 is a perspective view of a further embodiment of a partly shown inventive jewelry part in exploded form.
Figure 16:
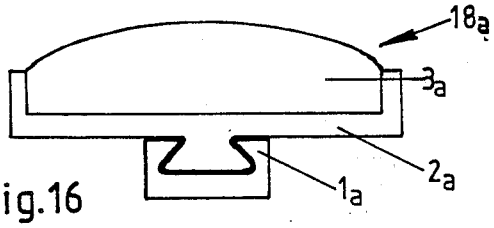
FIG. 16 is a front view of the assemble jewelry part according to FIG. 15.

Holding element 2 is maybe nonepermanently mounted on support 1 and can at any time be interchanged with a differently shaped holding element and/or a different gem 3. FIG. 14 shows the unit of an assembled jewelry part 18 formed from support 1, holding element 2 and gems 3. In the embodiment according to FIG. 15 a groove 19 is shaped into support 1*a*. A tongue-like strip 20 fits into said groove 19 and is placed on the underside of the U-shaped holding element 2*a*. The legs 14*a* of the holding element are at an angle w of approximately 90° to the base part 13*a*, so that the gem 3*a* can be bonded or clamped in said holding element 2*a*. The assembled jewelry item 18*a* comprising support 1*a*, holding element 2*a* and gem 3*a* is shown in FIG. 16.

Figure 17:
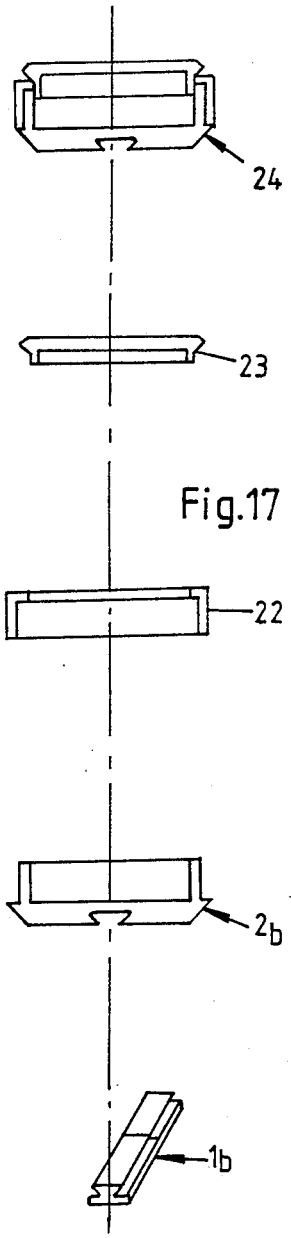
FIG. 17 is a diagrammatic exploded view of a wrist watch, partly in perspective form.
Figure 18:
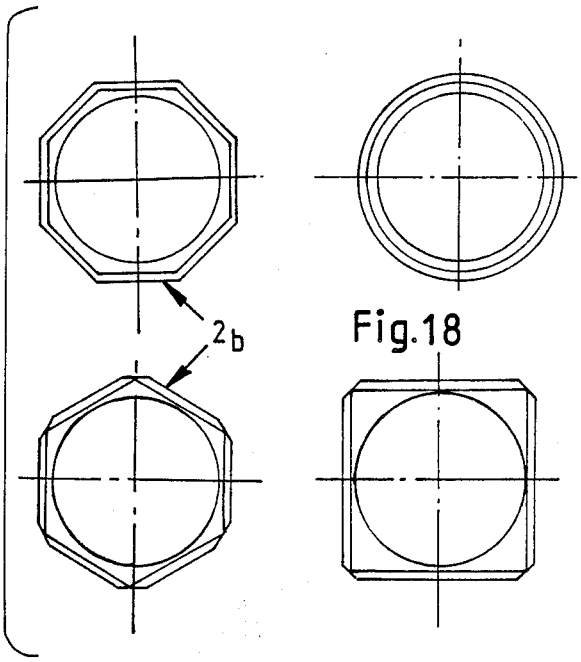
FIG. 18 is a representation of different forms of a clockwork mechanism mount.

According to FIG. 17 a holding element 2*b*, which is in this case a mount for a not shown clockwork or a watch case base is mounted on a rail band forming support 1*b*. This mount 2*b* can be in different forms, some of which are shown in exemplified manner in FIG. 18. A case frame 22 is then placed on mount 2*b* and a watch glass 23 engaged thereon. The watch glass 23 can also have a shade appropriate for the gems mounted on rail band 1*b* and is correspondingly changed on changing the gems.

The upper representation in FIG. 17 shows the assembled watch 24, which then only has to be engaged on rail band 2*b*. The result is a wrist watch, in the manner shown in FIG. 8, the remainder of the band or strap being provided with gems in holding elements.

Figure 19:
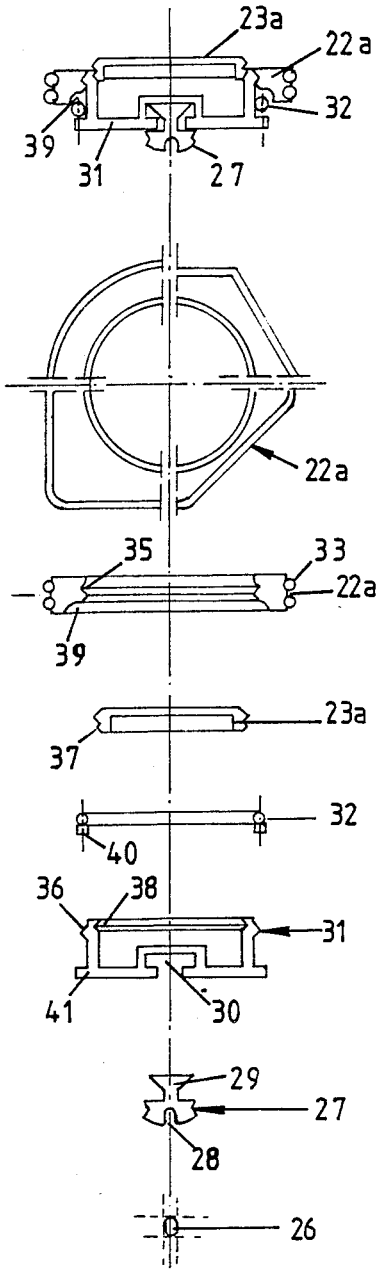
FIG. 19 is an exploded view of a further embodiment of a wrist watch.

According to the wrist watch embodiment of FIG. 19, the support comprises a rail element 27, which is placed on an elastic endless band or strap 26. For this purpose, rail element 27 has a channel 28 and a rail beam 29 embraced in the use position by an undercut groove 30 form on a watch case 31. Watch case 31 is embraced by a spring clip 32. There is also a watch glass 23*a* and a case frame 22*a* around which pass edge-protecting wires 33. This case frame determines the external shape of the watch, different possibilities being shown in exemplified form. The case frame 22*a* is also interchangeably constructed, and for this purpose is provided with an inner annular slot 35 that engages projections 36 on watch case 31. Watch glass 23*a* also has a circular collar 37, which engages in a locking groove 38 in what case 31.

Case frame 22*a* also covers the spring clip 32, but forms a movement zone 39 for the spring clip 32. Spring clip 32 is fixed via feet 40 to a bearing collar 41 of watch case 31.

Figure 20:
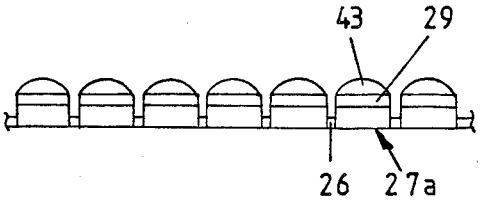
FIG. 20 is a side view of a continuous band or strap part with individual rail elements.

The arrangement of the spring clip for fixing the complete watch in particular serves its function when the rail elements 27*a*, together with the endless band 26 are joined in the manner of a zipper, as shown in FIG. 20. Round heads 43 then engage over the rail beams 29. This "zipper" can be injection molded in one piece from plastic.

Figure 21:
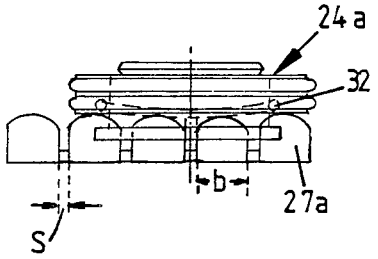
FIG. 21 is a side view of a stage in fixing a watch to the rail elements according to FIG. 20.
Figure 22:
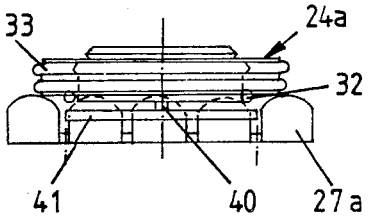
FIG. 22 is a side view of a further stage according to FIG. 21.

If a watch 24*a* is now mounted on said zipper, the spring clip 32 is raised due to the round head 43 and as shown in FIG. 21. After round passing over the head 43 spring clip 32 drops downwards into the closed position shown in FIG. 22. For this purpose, the spacing s between the rail elements 27*a* or the width b of a rail element beam must be dimensioned so that the spring clip 32 closingly surrounds one or more rail elements 27*a*.

Figure 23:
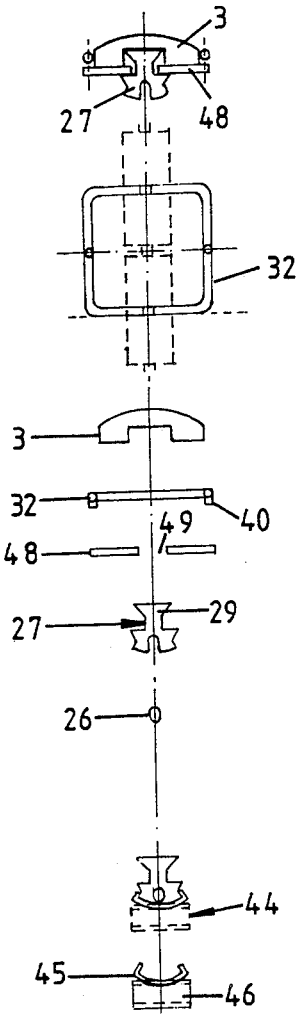
FIG. 23 is an exploded view of an embodiment of a decorative strap.
Figure 24:
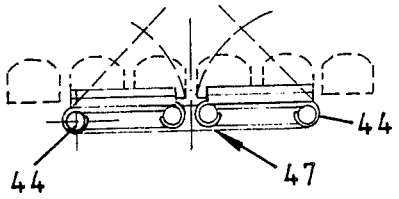
FIG. 24 is a side view of holding elements.
Figure 25:
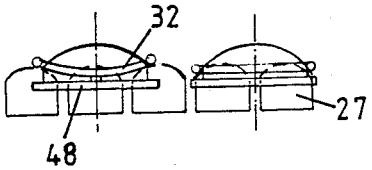
FIG. 25 is a side view of the decorative strap of FIG. 23 during the fixing of the gems.

According to FIG. 23 similar parts are used for fabricating a decorative strap as for fabricating a watch. Once again a rail element 27 is connected to an endless band or strap 26. The rail element 27 and endless band 26 can be held together by a hinge fastening 44, which comprises a clip part 45 and hinges 46 about which rotate two adjacent hinge fastenings 44. FIG. 24 shows a hinge closure 47, with which two hinge fastenings 44 can be coupled together. The holding element is in this case two guide plates 48, which are held together by spring clip 32 with feet 40, a gap 49 being formed for receiving rail element 27. The spring clip 32 is also shown in plan view in FIG. 23. Gem 3 is also located in the frame of spring clip 32 and is optionally fixed to the guide plates 48 or is held in clamping manner by spring clip 32. FIG. 25 shows two use positions of spring clip 32, the function of the latter being described relative to FIGS. 21 and 22.

I claim:

1. An assembly for mounting at least one gem stone or watch, said assembly comprising a plurality of support members, means coupling said support members to each other end-to-end, at least one holding element in which the gem stone or watch is held, the rear of said holding element and the front of each support member having complementary tongue and groove mounting means whereby said holding element may be mounted on any one of said support members with the remaining support members constituting a band for sand gem stone or watch, and wherein said plurality of support members each comprise a rail having said tongue on one surface in the form of a beam upon which said holding element may be mounted, each rail also having a groove in another surface, and said means for coupling said support members comprising an elongated flexible strap received in said groove of each rail.

2. The assembly according to claim 1 wherein said support members are flexibly coupled to each other.

3. The assembly according to claim 1 further including clip means for coupling said rail elements and elongated band.

4. The assembly according to claim 3 wherein each said rail element has a round head.

5. The assembly according to claim 3 wherein each said support member includes a bearing collar engaged by said clip means.

6. The assembly according to claim 3 wherein each said holding element comprises two bite plates that are coupled to each other by said clip means.

7. The assembly according to claim 1 wherein said holding element is in the form of a mount for a watch on which is mounted a case framed as the upper part and a watch glass.

8. The assembly according to claim 7 wherein said watch glass has a circular collar and engages in a locking groove in said mount and said case frame has an angular slot which engages projections in said mount.

* * * * *